United States Patent [19]

Lavin et al.

[11] Patent Number: 4,916,908

[45] Date of Patent: Apr. 17, 1990

[54] AIR SEPARATION

[75] Inventors: John T. Lavin, Guildford; David J. Layland, Basingstoke, both of England

[73] Assignee: The BOC Group, Inc., Murray Hill, N.J.

[21] Appl. No.: 320,673

[22] Filed: Mar. 8, 1989

[30] Foreign Application Priority Data

Mar. 18, 1988 [GB] United Kingdom ..... 8806478

[51] Int. Cl.[4] ..... F25J 3/04

[52] U.S. Cl. ..... 62/22; 55/66; 62/24

[58] Field of Search ..... 62/11, 22, 23, 24; 55/66

[56] References Cited

U.S. PATENT DOCUMENTS

| | | | |
|---|---|---|---|
| 4,137,056 | 1/1979 | Golovko | 62/24 |
| 4,338,108 | 7/1982 | Isalski et al. | 62/22 |
| 4,575,388 | 3/1986 | Okada | 62/22 |
| 4,704,148 | 11/1987 | Kleinberg | 62/24 |
| 4,747,859 | 5/1988 | Gladman et al. | 62/24 |
| 4,747,860 | 5/1988 | Atkinson | 62/24 |
| 4,818,262 | 4/1989 | Brugerolle | 62/22 |

*Primary Examiner*—Ronald C. Capossela
*Attorney, Agent, or Firm*—Carol A. Nemetz; R. Hain Swope; Larry R. Cassett

[57] ABSTRACT

A process for the separation of air to obtain oxygen, nitrogen and argon is disclosed which comprises: subjecting air from which carbon dioxide and water have been removed to fractional distillation in a first column to form oxygen-nitrogen vapor and argon-enriched oxygen; separating argon from the latter in a second column operating at substantially lower pressure than the first; liquefying a portion of the nitrogen vapor in a cycle including heat exchange with incoming air and compression to a pressure above that of the first column, a portion of the liquid nitrogen being taken as product and a second portion being returned to the first column as reflux. Liquid-oxygen and nitrogen vapor from the first column are mixed in a liquid-vapor contact column, impure liquid nitrogen is withdrawn therefrom and used as reflux in the first column. A remixed oxygen-nitrogen stream is withdrawn from the contact column and expanded to create refrigeration for the system. Also, disclosed is apparatus for carrying out the subject process.

15 Claims, 4 Drawing Sheets

AIR SEPARATION

This invention relates to process, apparatus and plant for separating air.

BACKGROUND OF THE INVENTION

Air is traditionally separated by fractional distillation at cryogenic temperatures utilizing either a single or double distillation column. Typically, both nitrogen and oxygen products are produced. In addition, by taking an argon-enriched vapor stream from the single or double distillation column and subjecting it to distillation in a further column, an argon product may also be produced. When, for example, both oxygen and nitrogen are required as products in the gaseous state, the incoming air is typically compressed to a pressure in the range of 6–7 atmospheres absolute in a plant using a double distillation column. Since there is a large demand for both liquid nitrogen and liquid oxygen, there is a need for plants that produce both of these products in the liquid state. Liquid oxygen that is collected at the bottom of the distillation column may be taken therefrom as product. The demand for liquid nitrogen may be met taking a gaseous nitrogen product and liquefying at least a portion of it. Modern nitrogen liquefiers typically include compressors that raise the pressure of the nitrogen to 40 atmospheres or more. Alternatively, the liquefaction plant may be integrated with the air separation plant such that the liquid nitrogen product can be taken in substantial quantities directly from the single or double distillation column.

In plants that produce essentially gaseous oxygen and nitrogen products, there have been proposed methods of providing increased argon production which involve the use of an additional liquid-vapor contact column to remix gaseous nitrogen and liquid oxygen and provide additional liquid nitrogen reflux to the column from which the argon-enriched vapor stream is taken for further separation. Such methods are described in European patent application No. 136 926A and international (PCT) patent application No. W087/00609. In addition, UK patent application No. 2 174 916A and European patent application No. 259 070A disclose the use of an additional liquid-vapor contact column to remix gaseous nitrogen and liquid oxygen when argon is required as the sole or primary product of air separation.

There have been no proposals in the art to use the principle of remixing liquid oxygen with gaseous nitrogen to give extra liquid nitrogen reflux in air separation plants that produce substantial quantities of liquid nitrogen product. The invention relates to process, apparatus and plant which employ remixing of liquid oxygen and nitrogen vapor and also produce a liquid nitrogen product.

SUMMARY OF THE INVENTION

According to the present invention, there is provided a process of separating air into oxygen, nitrogen and argon, comprising: removing carbon dioxide and water vapor from air and cooling it to a cryogenic temperature suitable for separation by fractional distillation; subjecting the air to fractional distillation in a first distillation column operating at a first pressure and withdrawing oxygen, nitrogen vapor and argon-enriched oxygen therefrom; subjecting the argon-enriched oxygen to further separation to produce argon in a second distillation column operating at substantially lower pressure; liquefying at least a portion of the nitrogen vapor by a cycle which shares at least one heat exchanger in common with the air being cooled and which employs compression of nitrogen to a third pressure substantially in excess of the first pressure; withdrawing a first portion of the liquid nitrogen as product and introducing a second portion into the first distillation column as reflux, wherein liquid oxygen and impure nitrogen are withdrawn from the first distillation column and remixed in a liquid-vapor contact column, impure liquid nitrogen is withdrawn from the liquid-vapor contact column and used as reflux in the first distillation column, and a remixed oxygen-nitrogen stream is withdrawn from the liquid-vapor contact column and is subjected to expansion to recover energy therefrom to create refrigeration.

The invention also provides apparatus or plant for separating air into oxygen, nitrogen and argon, comprising means for extracting carbon dioxide and water vapor from air; heat exchange means for cooling air to a cryogenic temperature suitable for separation by fractional distillation in a first distillation column, said column having outlets for the withdrawal of liquid oxygen, nitrogen vapor and argon-enriched oxygen; a second distillation column communicating with said outlet for argon-enriched oxygen operable to separate argon therefrom and having an outlet for the removal of argon; means for liquefying at least a portion of the nitrogen vapor by performing a cycle which utilizes at least part of said heat exchange means and which includes at least one compressor for raising the pressure of the nitrogen to a pressure substantially in excess of the pressure in the first distillation column; means for withdrawing a portion of the liquid nitrogen as product and means for returning a second portion of the liquid nitrogen as reflux to the first distillation column. The apparatus or plant additionally includes a liquid-vapor contact column for remixing liquid oxygen and impure nitrogen vapor having an inlet for liquid oxygen in communication with the outlet therefor from the first distillation column and an inlet for impure nitrogen vapor in communication with an outlet for such vapor from the first distillation column, and also having an outlet for impure liquid nitrogen, in communication with an inlet to the first distillation column, and another outlet for a remixed oxygen-nitrogen mixture communicating with at least one means for expanding said mixture to recover energy therefrom so as to create refrigeration.

DETAILED DESCRIPTION OF THE INVENTION

Figure 1:
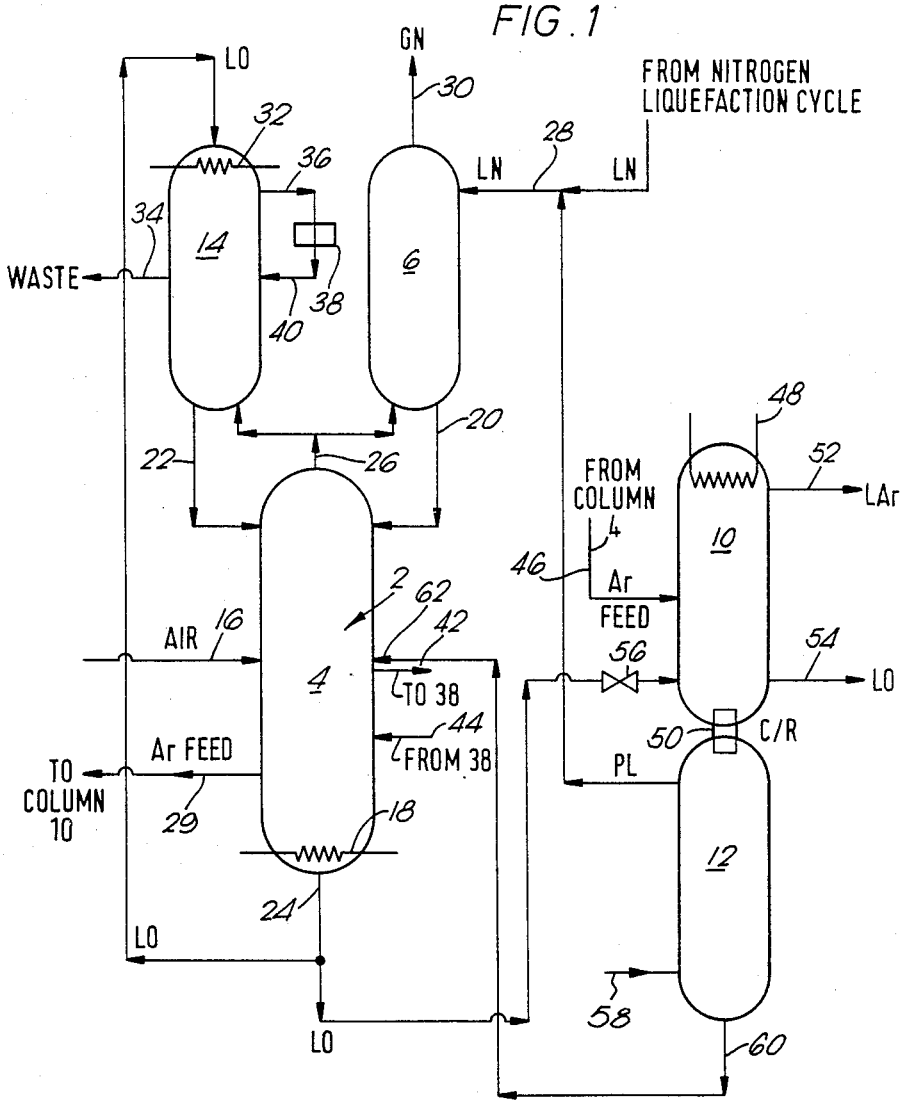
FIG. 1 is a schematic diagram illustrating one arrangement of distillation columns with a mixing column for use in performing the subject invention.

Referring to FIG. 1 of the drawings, there is shown an arrangement of distillation columns suitable for performing the process according to the invention. For ease of illustration, all heat exchangers, compressors, expansion turbines and valves are omitted from FIG. 1 save for one heat exchanger. The illustrated apparatus includes a first distillation column 2 which, although it may be a single vessel, is shown in a preferred form consisting of a lower vessel 4 and an upper vessel 6. Distillation column 2 is employed to separate air into oxygen, nitrogen and argon-enriched oxygen. The argon-enriched oxygen is separated in a second distillation column 10. The second distillation column 10 is reboiled by a third distillation column 12 which receives a portion of the air feed. In addition, there is a liquid-vapor contact or mixing column 14 in which liquid oxygen and nitrogen vapor from the lower vessel 4 are remixed such that nitrogen reflux can be provided to the lower vessel 4. The two vessels, 4 and 6, interchange impure nitrogen, vapor passing from the lower vessel 4 to the upper vessel 6 and liquid passing in the opposite direction. Reflux for the upper vessel 6 is provided from a nitrogen liquefaction cycle as will be described, whereas a reflux for the lower vessel is provided by the mixing column 14.

Typically, the liquid-vapor contact column 14 (also referred to herein as the mixing column) is operated at essentially the same pressure as the first distillation column 2, Preferably at least about 3 atmospheres and more preferably at least about 5 atmospheres. Remixing of the oxygen and nitrogen can be conducted with greater thermodynamic efficiency at pressures of at least about 3 atmospheres than at substantially lower pressures. Moreover, by operating the liquid-vapor contact column at such pressures, work expansion of the oxygen-nitrogen mixture withdrawn can provide a significant recovery of energy in the form of refrigeration which helps to meet the overall requirements for refrigeration of the process. As a result, the pressure at which nitrogen is recompressed, as will be detailed hereafter, is lower than that which would be required for a fully comparable method not employing a mixing column.

Air, typically at its dew point, is fed at an elevated pressure, e.g. 6 atmospheres absolute, through an inlet 16 into the lower vessel 4. The air is subjected to fractional distillation in the lower vessel 4, reboil being provided at the bottom of the vessel 4 by means of a reboiler 18 and impure liquid nitrogen reflux being provided to the top of the vessel 4 from the upper vessel 6 via conduit 20, and from the bottom of the mixing column 14 via conduit 22. Accordingly, there is established in the column 4 a downward flow of liquid that becomes progressively richer in oxygen and an upward flow of vapor that becomes progressively richer in nitrogen. Commercially pure liquid oxygen is withdrawn from the bottom of the lower vessel 4 of the distillation column 2 through an outlet 24, an impure nitrogen vapor stream is withdrawn through an outlet 26 at the top of the vessel 4 and an argon-enriched liquid stream is withdrawn through an outlet 29 at a level intermediate those of the air feed inlet 16 and the liquid oxygen outlet 24. Outlet 29 for the argon-enriched oxygen stream is positioned where the concentration of argon in the liquid phase in the vessel 4 is at or near a maximum such that the stream withdrawn through the outlet 29 typically contains on the order of about 8 to 10% by volume of argon.

The stream withdrawn from the top of the vessel 4 is typically an impure nitrogen vapor stream containing about 1 to 2% by volume of oxygen. A portion of this stream is passed to the upper vessel 6 in which there is an upward flow of nitrogen vapor that becomes progressively richer in nitrogen and a downward flow of liquid which becomes progressively richer in oxygen. Impure liquid nitrogen, typically containing about 2% by volume of oxygen, is withdrawn from the bottom of the upper vessel 6. This liquid nitrogen is employed as a part of reflux in the lower vessel 4. Reflux for the upper vessel 6 is provided by a stream of liquid nitrogen entering near the top through a conduit 28. Liquid nitrogen is supplied from a nitrogen liquefaction cycle which uses heat exchangers (not shown) to cool the air to be liquefied. A substantially pure gaseous nitrogen stream is withdrawn from the vessel 6 through an outlet 30.

The other portion of the stream of impure nitrogen withdrawn from the lower vessel 4 through the outlet 26 is passed to the bottom of the liquid-vapor contact or mixing column 14. This impure nitrogen is remixed in the column 14 with a part of the liquid oxygen withdrawn from the bottom of the vessel 4 through the outlet 24, such liquid oxygen being introduced into the column 14 through its top. There is thus established in the column 14 an upward flow of vapor which undergoes mass exchange with a downward flow of liquid, such that the liquid as it descends becomes progressively richer in nitrogen and the vapor as it ascends becomes progressively richer in oxygen. In order to enhance the downward flow of liquid, the column 14 is provided with a condenser 32 at its top to condense oxygen vapor. For ease of illustration, the means of providing cooling fluid to the condenser 32 is not shown in FIG. 1. Typically, the liquid nitrogen which is returned to vessel 4 as reflux from the column 14 contains from 3 to 6% by volume of oxygen.

A mixed oxygen-nitrogen stream is withdrawn from an intermediate level from column 14 through a conduit 34. Although the concentration of oxygen in the mixed stream may vary, it typically contains about the same concentration as air, i.e. about 21% by volume. The stream withdrawn through the conduit 34 is subjected to expansion to recover energy therefrom by means not shown in FIG. 1. Withdrawal of this stream maintains a mass balance in the column 14 and helps to improve the efficiency thereof. The efficient operation of the column 14 is also facilitated by utilizing an operating pressure in excess of about 3 atmospheres absolute. The column 14 and the upper vessel 6 are typically operated at substantially the same pressure as the lower vessel 4, that is on the order of 6 atmospheres although, because of liquid head effects, the average pressure in the column 14 and in the vessel 6 will be a little less than in the vessel 4, e.g. about 5.8 atmospheres absolute.

With the aim of enhancing the efficiency with which the column 14 operates, a second stream of a mixed oxygen/nitrogen vapor is withdrawn from the column 14 through a conduit 36 at a level above the conduit 34 but below that of the lowest level at which mass exchange takes place between liquid and vapor. Typically, the vapor stream withdrawn through the conduit 36 contains about 45–50% by volume of oxygen, preferably about 47% by volume. This vapor is condensed in a condenser 38 and the resulting liquid is returned to the column 14 through a conduit 40 at a level such that the composition of the returning liquid is approximately the same as the composition of the liquid to which it is returned. Refrigeration for the condenser 40 is provided by withdrawing a stream of oxygen-enriched liquid from the lower vessel 4 of distillation column 2 through conduit 42 and passing it to the condenser 38 such that it undergoes heat exchange with the stream withdrawn from the column 14 through the conduit 36, condenses upstream, and is itself reboiled. The resulting vapor is then returned to the vessel 4 by way of an inlet 44 which typically is located at a level such that the composition of the returning vapor matches that of the liquid to which it is returned.

In order to produce an argon product, the argon-enriched oxygen liquid stream withdrawn from the vessel 4 through outlet 29 is passed to a sub-cooler (not shown), passed through a throttling valve (not shown) and then introduced through an inlet 46 into the column 10 where it is separated by distillation into oxygen and argon products, the latter typically containing on the order of about 2% by volume of oxygen impurity. Accordingly, in the column 10, a generally downwardly flowing stream of liquid is contacted by an upwardly flowing stream of vapor. Mass exchange takes place such that the downward flowing liquid becomes progressively richer in oxygen and the upward flowing vapor becomes progressively richer in argon. Condenser 48 at the top of column 10 provides liquid argon reflux for the column and a reboiler at 50 at the bottom provides an ascending stream of vapor. Reboiler 50 also functions as a condenser for the column 12 to provide reflux therefor. A liquid argon product is withdrawn from the top of column 10 through outlet 52 and a liquid oxygen product is similarly withdrawn at its bottom through outlet 54.

The column 10 is typically operated at a pressure a little above atmospheric, for example 1.3 atmospheres absolute. In order to provide a suitable temperature difference across the condenser-reboiler 50, column 12 is operated at 6 atmospheres absolute (that is at substantially the same pressure as the lower vessel 4). Since it is generally desirable to take liquid oxygen product from the apparatus shown in FIG. 1 at a relatively low pressure, some of the liquid oxygen withdrawn from the bottom of the lower vessel 4 through the outlet 24 is transferred to the bottom of the column 10 via an expansion valve 56. Accordingly, the rate at which liquid oxygen is withdrawn from the column 10 through the outlet 54 is enhanced.

As aforementioned, column 12 provides reboil for the column 10. A minor proportion of the incoming air, which is at its dew point, is introduced into column 12 through inlet 58. The air is separated in the column 12 into an oxygen-rich fraction collecting at the bottom and a nitrogen fraction collecting at the top. The oxygen-rich liquid is withdrawn through outlet 60 and introduced into column 4 through inlet 62. Since there is withdrawal of liquid from the bottom of column 12, there is no need to provide reboil for it. A nitrogen vapor-liquid mixture is withdrawn from the top of the column 12 and united with the liquid nitrogen being introduced into the upper vessel 6 of the distillation column 2 through the inlet 28.

Each of the columns 2, 10, 12 and 14 typically includes a multiplicity of liquid-vapor contact trays (not shown) to effect mass transfer between the liquid and vapor phases. Alternatively, structured packings can be used for this purpose. If trays are used, they are of the sieve tray type. The lower vessel 4 may typically be operated with 89 theoretical trays, the upper vessel 6 with 16.5 theoretical trays, the second distillation column 10 with 73 theoretical trays, the additional distillation column 12 with 42 theoretical trays, and the mixing column 14 with 35 theoretical trays. (The number of actual trays employed will be the number of theoretical trays multiplied by the inverse of the tray efficiency.)

Figure 2:
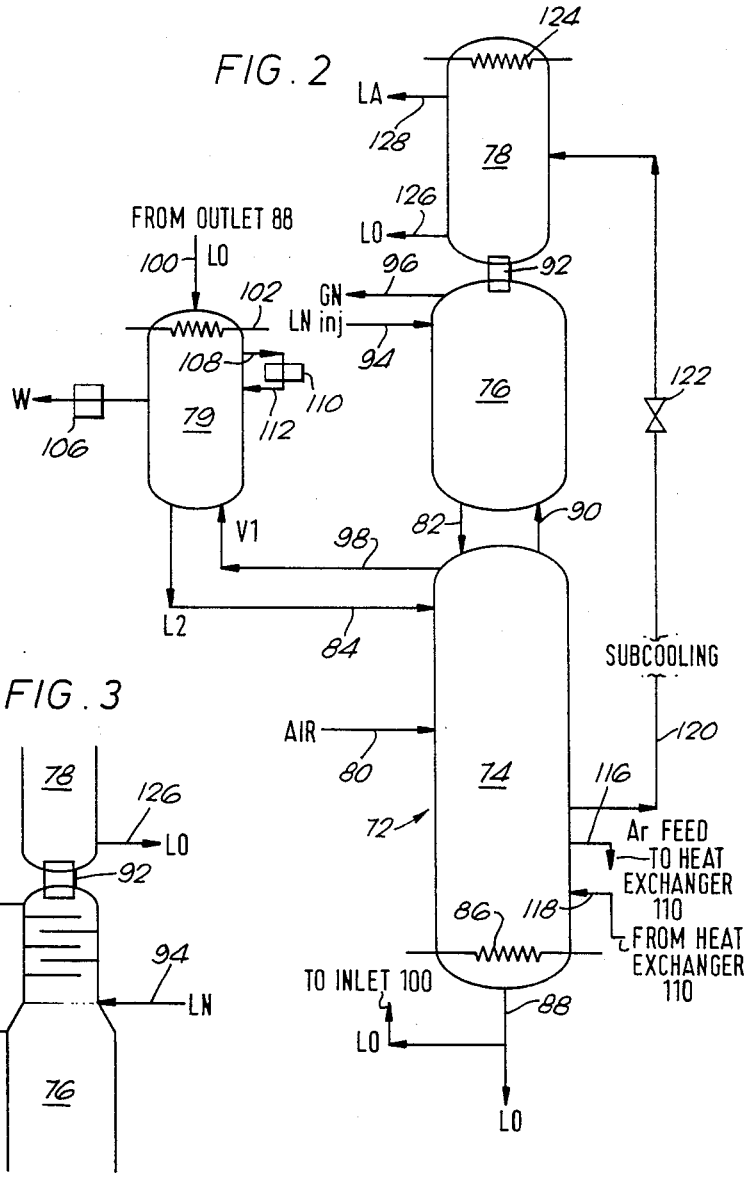
FIG. 2 is a schematic diagram illustrating an alternative arrangement of columns to that shown in FIG. 1.

Referring now to FIG. 2, the apparatus shown therein comprises a similar arrangement of columns to the one shown in FIG. 1 save that the first distillation column is employed to reboil the second distillation column with the result that apparatus shown in FIG. 2 employs one less distillation column than the apparatus shown in FIG. 1. It is preferred that the second distillation column be reboiled and that reboil be provided by the first distillation column. Alternatively, an additional distillation column which receives a portion of the air feed may be used for this purpose. Reboiling of the second distillation column makes it possible to withdraw therefrom a relatively pure oxygen product, typically in the liquid state. This is advantageous when liquid oxygen is required as the product, as the second distillation column operates at a pressure nearer atmospheric than the first distillation column. Typically, the second distillation column operates at a pressure between one and two atmospheres absolute while the first distillation column and the mixing column operate at pressures between about 5.5 and 6.5 atmospheres absolute.

The apparatus shown in FIG. 2 includes a first distillation column 72, comprising a lower vessel 74 and an upper vessel 76, a second distillation column 78, and a liquid-vapor contact or mixing column 79.

Air, typically at a pressure of 6 atmospheres absolute and at its dew point, is passed into the lower vessel 74 of the first distillation column 72 and is separated by fractional distillation into oxygen, argon-enriched oxygen and impure nitrogen fractions. Vessel 74 receives impure liquid nitrogen reflux from the upper vessel 76 via conduit 82 and from the mixing column 79 via conduit 84 which places the bottom of the mixing column 79 in communication with the top of vessel 74. The lower vessel 74 also contains near its bottom reboiler 86 which is adapted to provide an upward flow of vapor to come into mass transfer relationship with a downward flow of liquid such that the descending liquid becomes richer in oxygen and the ascending vapor becomes richer in nitrogen. For ease of illustration, the source of the fluid providing the reboil is not shown in FIG. 2.

Liquid oxygen is withdrawn from the bottom of vessel 74 through an outlet 88. A portion of this liquid oxygen may be taken as product directly or first introduced into the column 78 and taken therefrom as product. The remainder of the liquid oxygen leaving the vessel 74 through outlet 88 is passed to the top of the mixing column 79. Impure nitrogen vapor is withdrawn from the top of the vessel 74 in two streams. A first stream withdrawn through a conduit 90 enters the bottom of the upper vessel 76. The vapor ascends the vessel 76 and comes into mass transfer relationship with a descending stream of liquid created by condensing a portion of the vapor at the top of the vessel 76 in a condenser 92. The condenser 92 also serves to provide reboil for the second distillation column 78. Further liquid nitrogen reflux is provided by introducing liquid nitrogen into the upper vessel 76 through inlet 94. The liquid nitrogen is produced in a liquefier cycle (not shown in FIG. 2) which uses heat exchangers (not shown) employed to cool the incoming air.

The second stream of impure nitrogen vapor is withdrawn from the lower vessel 74 of distillation column 72 though conduit 98 into the bottom of the liquid-vapor contact column 79. The nitrogen vapor is mixed with liquid oxygen supplied through inlet 100 to the top of the column 79 from the outlet 88 at the bottom of vessel 74 of distillation column 72. The operation of the mixing column 79 is generally similar to that of the mixing column 14 shown in FIG. 1. In particular, the mixing column 79 is provided with a condenser 102 to provide additional liquid reflux. The column is operated at substantially the same pressure as the lower vessel 74 though typically there will be a slight difference in pressure to allow for the flow of liquid under gravity from the column 79 back into the vessel 74. Such liquid flow takes place via the conduit 84 as aforesaid. As the liquid descends the column 79, it undergoes mass exchange with ascending vapor and becomes progressively richer in nitrogen and whereas the ascending vapor becomes progressively richer in oxygen. The vapor at the top of the column is condensed by condenser 102. Typically, the liquid nitrogen returned to the vessel 72 as reflux therein is impure, typically containing up to 6 mole per cent of oxygen.

A mixed oxygen-nitrogen stream is withdrawn from the mixing column 79 at an intermediate level thereof and passed along a conduit 106 for expansion to recover energy therefrom, for example, in an expansion turbine (not shown in FIG. 2). The oxygen content of stream withdrawn through the conduit 106 typically about the same as that of air. There is also withdrawn from the mixing column 79 through outlet 108 a mixed oxygen-nitrogen stream enriched in oxygen relative to the stream withdrawn through conduit 106. This stream is passed to the heat exchanger 110 in which it is condensed, and the resulting liquid returned to column 79 through inlet 112 at a level such that the composition of the returning liquid is approximately the same as that in the column. Condensation of the vapor in the heat exchanger 110 is effected by heat exchange with a stream of liquid withdrawn from the lower vessel 74 of distillation column 72 through outlet 116. This liquid is reboiled in the heat exchanger 110 and returned as a vapor to the vessel 74 through inlet 118 located such that typically its composition matches that in the column.

In addition to the withdrawal of substantially pure liquid oxygen through the outlet 88 and impure nitrogen through the conduits 90 and 98, a stream of argon-enriched oxygen liquid is also withdrawn from the vessel 74. This stream is taken at a level below that of the air inlet 80 where there is a relatively high concentration of argon in the liquid phase, for example, 8–10% by volume. The argon-enriched oxygen stream passes from the vessel 74 into conduit 120, is sub-cooled in a heat exchanger (not shown in FIG. 2), passed through an expansion valve 122 and is then introduced into the column 78 which typically operates at a pressure a little above atmospheric (e.g. 1.3 atmospheres absolute. The argon-enriched oxygen is separated into oxygen and argon fractions in the column 78. The argon fraction typically contains up to 2% by volume of oxygen. The column 78 is provided as aforesaid with a reboiler 92 to reboil liquid at the bottom and a condenser 124 at its top to condense vapor, thus providing liquid reflux for the column 78. Accordingly, liquid descends the column 78 and comes into mass transfer relationship with an ascending vapor. Liquid becomes progressively richer in the less volatile constituent (oxygen) as it descends the column while the vapor similarly becomes richer in the more volatile component (argon) as it ascends the column 78. Liquid oxygen product is withdrawn from the bottom of the column 78 through outlet 126 and liquid argon product is withdrawn from the top through outlet 128.

As with the apparatus shown in FIG. 1, typically all the columns have liquid-vapor contact trays to facilitate mass transfer between the liquid and vapor phases or are provided with suitable packings for this purpose. Typically, the vessel 74 may have at least 93 theoretical trays as follows: 35 theoretical trays between the top of the vessel 74 and the level of the air inlet 80; 5.4 theoretical trays between the level of the air inlet 80 and the level of the inlet 118; 17 theoretical trays between the level of the inlet 118 and the level of the inlet to the conduit 120, and 35.6 theoretical trays below the level of the inlet to the conduit 120. The vessel 76 may have 18.2 theoretical trays; the column 78 may have 81.3 theoretical trays, 45.9 above the level of the air feed, and 35.4 below the level of the air feed, and the column 79 may have 35 theoretical trays, 17 below the level of the inlet to the conduit 106; 8 between the inlet to the conduit 106 and the level of the outlet 108, and 10 above the level of the outlet 108.

Figure 3:
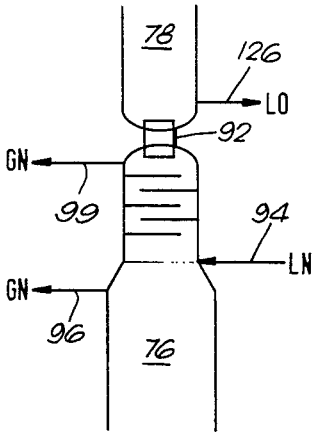
FIG. 3 illustrates a detail of a further modified arrangement of columns for use in performing the invention.

Referring now to FIG. 3, there is shown a modification to the upper vessel 76 of the distillation column 72. Typically, the liquid nitrogen produced in the upper vessel 76 of the distillation column 72 contains up to 200 vpm of impurities (excluding argon). If nitrogen of a higher purity is required, the liquid nitrogen reflux is introduced into the column 76 through the inlet 94 at a level several trays, e.g. 5 below that at which a pure gaseous nitrogen product is withdrawn through conduit 96. Accordingly, most of the impurities (excluding argon) are transferred from the ascending vapor phase to the descending liquid phase between the level of the inlet 94 and that of the outlet 99 such that the resultant gaseous nitrogen typically contains only about 1 vpm impurities (excluding argon).

Preferably, reboil for the first distillation column is provided by a stream of nitrogen at least part of which is liquefied downstream of where it provides reboil for the first distillation column. Accordingly, there is preferably performed a nitrogen liquefaction cycle comprising the steps of withdrawing nitrogen vapor from said first distillation column, warming the nitrogen vapor countercurrently to the air in heat exchange means, compressing some of the warmed nitrogen, cooling and reducing the temperature of such compressed nitrogen in the heat exchange means, taking at least some of the cooled nitrogen and subjecting it to expansion with the performance of external work, i.e. recovery of energy, passing such expanded nitrogen through a reboiler associated with the first distillation column to provide reboil therein, subjecting the nitrogen leaving the reboiler to further cooling in the heat exchange means, employing a portion of the resulting liquid nitrogen as reflux in the distillation, and taking another portion of the resulting liquid nitrogen as product. In addition to employing a stream of nitrogen to reboil the first distillation column, a stream of air can be used for this purpose. In one preferred example, a stream of air preferably at its dew point is used to provide some of the reboil for the first distillation column and the resulting liquid air is then introduced into the first distillation column.

The nitrogen withdrawn from the first distillation column is typically compressed in a multi-stage compressor to a pressure in excess of its critical pressure. The compressed nitrogen is preferably taken for expansion with the performance of external work at a pressure in the range 50 to 75 atmospheres (and a temperature in the range 150 to 170K). It is not essential to take all the compressed nitrogen for expansion with the performance of external work. If desired, some of the compressed nitrogen may be liquefied without passing through the work expansion means and the reboiler associated with the distillation column.

At the completion of work expansion, the nitrogen preferably has a pressure in the range 12 to 20 atmospheres absolute and is preferably a saturated vapor. Liquefaction of the nitrogen is then preferably effected in the reboiler associated with the first distillation column.

Preferably, liquid nitrogen leaving the reboiler is sub-cooled by heat exchange and then subjected to a plurality of flash separation steps to provide liquid nitrogen and a plurality of flash gas streams. The flash gas streams are desirably returned through the heat exchange means counter- currently to the incoming air and therefore provide refrigeration for the heat exchange means. If desired, at least three flash separation steps may be used. Preferably, liquid nitrogen from a first flash separation step is employed to condense nitrogen vapor from the liquid-vapor contact column, the resulting condensate being returned to the column as reflux.

There will now be described two examples of processes and plants employing apparatus such as that shown in FIGS. 1 and 2.

Figure 4:
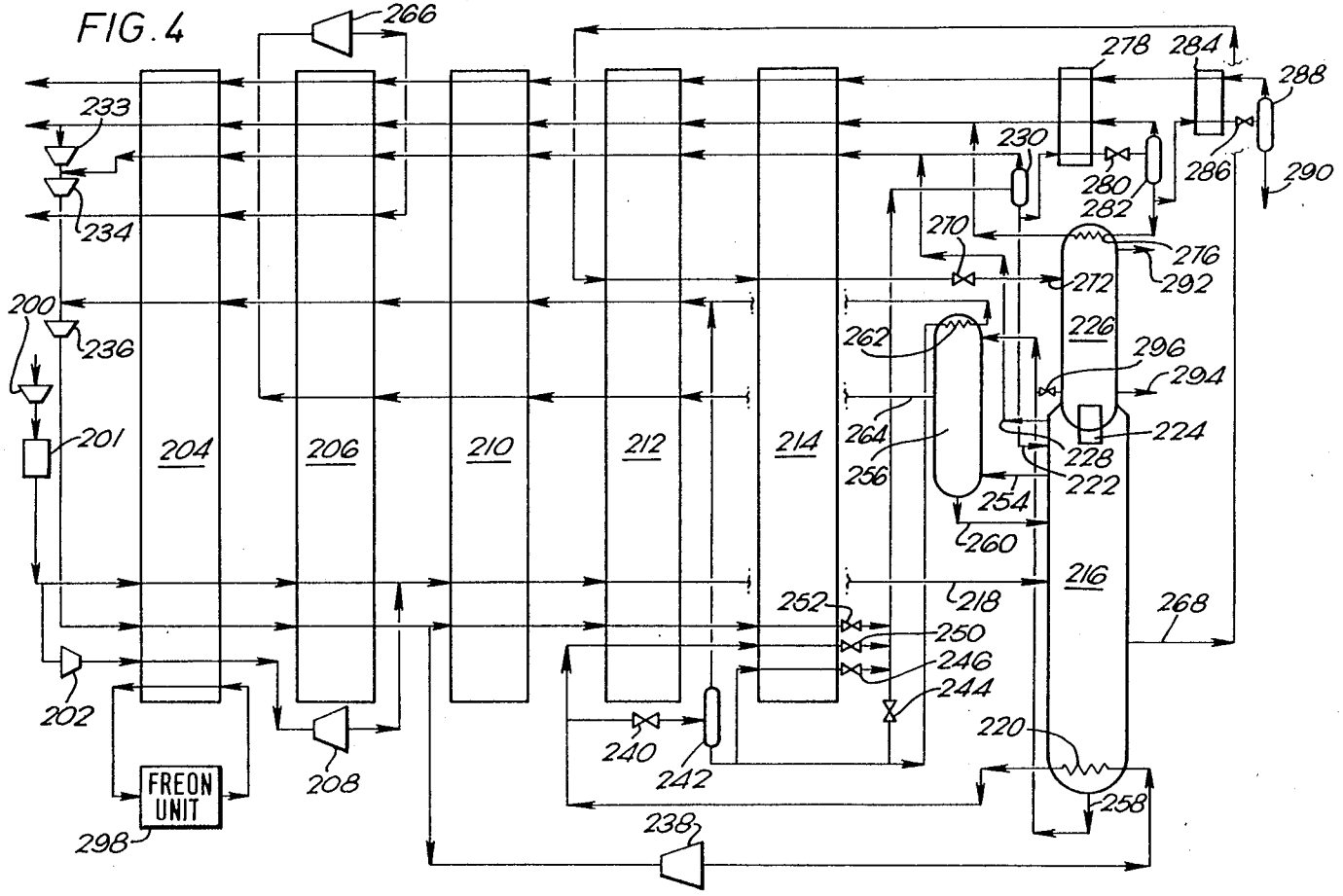
FIG. 4 illustrates a plant for performing the process of the invention which utilizes the arrangement of columns shown in FIG. 2.

Referring first to FIG. 4, there is shown a plant employing a column system analogous to that shown in FIG. 2, except that the first distillation column comprises just a single vessel.

Referring to FIG. 4, 130,000 $sm^3$/hr of air are compressed in compressor 200 to a pressure of 6.2 atmospheres absolute. (As used herein, 1 $sm^3$/hr = 1 $m^3$/hr at 15° C. and 1 atmosphere absolute.) Water vapor, carbon dioxide and the like are removed from the air in a purifier 201 which, preferably, comprises a plurality of adsorbent beds as is well known in the art. The stream is split and a portion, 44967$sm^3$/hr, of the purified compressed air is further compressed in compressor 202 to a pressure of 30 atmospheres absolute. The two air streams then flow through a first heat exchanger 204 in which they are cooled from of 298K to 235K. The larger air stream is further cooled in heat exchanger 206 to 159K. The minor (30 atmosphere) air stream bypasses the heat exchanger 206 and is instead expanded in an expansion turbine 208 to a pressure of 6.1 atmospheres absolute with the performance of external work. The resulting expanded air leaves the turbine 208 at 159K and is reunited with the other air stream between heat exchanger 206 and a further heat exchanger 210 where the combined stream is cooled to 113.6K. The air is further cooled in a heat exchanger 212 to 101K (its dew point) and is introduced at a pressure of 6 atmospheres absolute through inlet 218 into a first or main distillation column 216 in which it is separated into a nitrogen fraction at the top and an oxygen fraction at the bottom.

The distillation column 216 contains a reboiler 220 and an inlet 222 for substantially pure liquid nitrogen reflux at its top. In addition, there is a condenser-reboiler 224 which condenses vapor at the top of the column 216 and provides reboil at the bottom of a second distillation column 226. Nitrogen that passes through the reboiler 220 and into the inlet 222 of the column 216 is provided in a nitrogen refrigeration and liquefaction cycle that starts and ends in the column 216. Thus, substantially pure nitrogen vapor is withdrawn from the top of the column 216 through an outlet 228 at 111755 $sm^3$/hr and 96K and is united with a further 13772 $sm^3$/hr of nitrogen taken from a phase separator 230 (whose place in the cycle will be described below). The combined nitrogen stream then flows through a heat exchanger 214 from its cold end to its warm end and is thereby raised in temperature to 98K. It then flows sequentially through heat exchangers 212, 210, 206 and 204 counter- currently to the incoming air flow and leaves the heat exchanger 204 at 298K.

The nitrogen stream leaving the heat exchanger 204 is mixed with a stream of nitrogen passing from a compressor 233 at 20,081 $sm^3$/hr and about 5½ atmospheres absolute and further compressed in a compressor 234 to a pressure of 11 atmospheres. The resulting mixed stream at 11 atmospheres is combined at 298K with a yet further stream of nitrogen flowing at a rate of 33988 $sm^3$/hr. This mixed stream is compressed to a pressure of 59 atmospheres in compressor 236. The resulting compressed stream flowing at 179596 $sm^3$/hr, passes sequentially through heat exchangers 204 and 206 cocurrently with the incoming air, being thereby cooled to 159K. The stream is split, the major part, 134213 $sm^3$/hr, being passed to an expansion turbine 238 where it is expanded with the performance of external work, leaving the turbine at a pressure of 17.6 atmospheres and a temperature of 113.6K. This fluid stream then passes through the reboiler 220 of the first distillation column 216 thus providing reboil at the bottom of the column 216, the nitrogen itself being at least partially condensed. The resulting nitrogen stream is again divided into major stream and minor streams. The major stream is flashed through a Joule-Thomson or throttling valve 240 at 118424 $sm^3$/hr and is thereby reduced in pressure to 11 atmospheres. The resulting two-phase mixture is separated in a phase separator 242. The vapor stream withdrawn from separator 242 is warmed to 298K by sequential passage through heat exchangers 212, 210, 206 and 204 and is used as the nitrogen which is mixed with the 11 atmosphere stream of nitrogen intermediate the compressors 234 and 236.

Most of the resulting liquid collected in the phase separator 242 is used to make one contribution to a two-phase stream which is passed to a further phase separator 230. Accordingly, a first flow of 71052 $sm^3$/hr of this liquid is flashed through a throttling or Joule-Thomson valve 244 and the resultant liquid-vapor mixture passed to the phase separator 230. Upstream of phase separator 230, this liquid-vapor mixture is combined with a further stream of liquid-vapor mixture which is formed by taking another stream of liquid nitrogen at 3384 $sm^3$/hr from the bottom of the phase separator 242 (at a temperature of 105K), sub-cooling the stream to 98K by passage through the heat exchanger 214, and flashing it through throttling valve 246, thereby reducing its pressure to 5.8 atmospheres absolute. Another contribution to the liquid-vapor mixture passing to the phase separator 230 is formed from the minor stream of liquid from the reboiler 220 which by-passes the valve 240 and flows at 15789 $sm^3$/hr (17.6 atmospheres absolute) through the heat exchanger 212, being thereby cooled to a temperature of 101K. The resulting liquid is then further cooled to 98K by passage through heat exchanger 214. This cooled nitrogen is then flashed through a throttling or Joule-Thomson valve 250 and is then united with the liquid-vapor mixture passing to the phase separator 230. A fourth and final contribution to the liquid-vapor mixture passing to the phase separator 230 is formed by the minor part of nitrogen stream from the heat exchanger 206 that bypasses the expansion turbine 238. This part of the nitrogen stream flows 45383 $sm^3$/hr and 59 atmospheres absolute sequentially through heat exchangers 210, 212 and 214. The nitrogen leaves the warm end of the heat exchanger 214 at 98K and is then passed through a throttling or Joule-Thomson valve 252 to reduce its pressure to 5.8 atmospheres. The resulting liquid-vapor is as aforesaid mixed with the rest of the liquid-vapor mixture passing to the phase separator 230.

The liquid nitrogen collecting in the phase separator 230 is used for three purposes. A portion is returned to the first distillation column 216 to serve as reflux. A second portion is eventually collected as product. A third portion provides condensation of vapor at the top of the second distillation column 226 in which a liquid argon product is formed. For the present, only the first flow of liquid nitrogen back to the distillation column 216 will be described. This flows at a rate of 61555 $sm^3$/hr.

In order to provide additional reflux for column 216 a stream of impure nitrogen vapor is withdrawn from the column 216 through outlet 254 at 97287 $sm^3$/hr. This nitrogen vapor typically contains about 2% by volume of oxygen. The stream is introduced into the bottom of a mixing column 256 wherein it ascends and is contacted with a descending stream of liquid. Accordingly, a liquid oxygen stream is withdrawn from the bottom of the column 216 through an outlet 258. The major portion of the liquid oxygen stream is passed at 14772 $sm^3$/hr into the top of the mixing column 256. Thus, there is a downward flow of liquid through column 256 that becomes progressively richer in nitrogen and an upward flow of vapor that becomes progressively richer in oxygen. Impure liquid nitrogen is withdrawn from the bottom of column 256 through outlet 260 at 47060 $sm^3$/hr and is returned to distillation column 216 to provide further reflux therefor. Additional reflux for column 256 is created by operation of a condenser 262 therein. The condenser is cooled by a yet further portion of liquid nitrogen taken from the phase separator 242. Thus, liquid nitrogen at 18703 $sm^3$/hr flows into the condenser 262 at 11 atmospheres and 105K and condenses oxygen vapor at the top of column 256. The nitrogen is itself vaporized and is used to form part of the flow of nitrogen at 11 atmospheres that is mixed with the nitrogen passing from the compressor 234 to the compressor 236. The remainder of such flow is made up of 15285 $sm^3$/hr of nitrogen gas withdrawn from the phase separator 242 and mixed with the stream of vaporized nitrogen passing out of the condenser 262. The combined stream flows back through heat exchangers 212, 210, 206 and 204 countercurrently to the incoming air before being mixed with the nitrogen intermediate the compressors 234 and 236.

In addition to the stream of impure nitrogen withdrawn from the bottom of the mixing column 256 through the outlet 260, a stream of nitrogen-oxygen vapor is withdrawn from an intermediate region of the column 256 through an outlet 264 at 65,000 $sm^3$/hr The mixed stream, which typically contains 21% by volume of oxygen, sequentially flows through heat exchangers 212, 210 and 206 countercurrent to the flow of incoming air and is thus warmed to 230K. The mixed nitrogen-oxygen stream is then expanded with the performance of external work in an expansion turbine 266 exiting at 155K and 1.1 atmospheres absolute. It is warmed to 298K by sequential passage through heat exchangers 206 and 204 and then vented to the atmosphere.

In addition to producing nitrogen and oxygen fractions, the distillation column 216 also provides an argon-enriched oxygen liquid feed to the second distillation column 226. Accordingly, argon-enriched oxygen liquid, typically containing about 8% by volume of argon, is withdrawn through outlet 268 at 13050 $sm^3$/hr from a level in the column 216 below that of air inlet 218 and is subcooled by passage through heat exchangers 212 and 214 from the warm end to the cold end. The sub-cooled mixture is flashed through a throttling or Joule-Thomson valve 270 and introduced into the column 226 through inlet 272 at 1.3 atmospheres absolute. Reboil for the column 226 is provided by the condenser-reboiler 224 and reflux is provided by operation of condenser 276 at the top thereof. Cooling for condenser 276 is provided by a stream of liquid nitrogen from the phase separator 230 at 70281 $sm^3$/hr which is sub-cooling from 96K to 90K in heat exchanger 278, flashed through a throttling or Joule-Thomson valve 280, and passed to a phase separator 282 operating at a pressure of 3 atmospheres absolute. A first stream of liquid withdrawn from the phase separator 282 at 41389 $sm^3$/hr is passed through the condenser 276 thus condensing vapor and hence providing reflux in the column 226 while being vaporized itself. The resulting vapor is the mixed with vapor withdrawn from the top of the phase separator 282, and is returned through the heat exchanger 278 countercurrently to the flow therethrough of liquid nitrogen from the phase separator 230. The nitrogen vapor is thus warmed to 94K. It is subsequently warmed to 298K by sequential passage through heat exchangers 214, 212, 210, 206 and 204. Gaseous nitrogen product at 2.8 atmospheres is taken from this stream of nitrogen at 26213 $sm^3$/hr whereas the remainder of the flow (20081 $sm^3$/hr) is that compressed in compressor 233.

A second stream of liquid nitrogen is withdrawn from the phase separator 282 at 23989 $sm^3$/hr and sub-cooled from 90K to 88K in heat exchanger 284. The sub-cooled liquid nitrogen is flashed through a throttling or Joule-Thomson valve 286 and the resulting two-phase mixture collected in phase separator 288. Saturated liquid nitrogen product withdrawn from phase separator 288 at 1.3 atmospheres absolute and 21699 $sm^3$/hr. Nitrogen vapor is withdrawn from the top of the phase separator 288 at 2287 $sm^3$/hr and is warmed to 298K by sequential passage through heat exchangers 284, 278, 214, 212, 210, 206 and 204. This gaseous nitrogen is also collected as product.

By providing reboil and reflux in column 226, it is possible to separate liquid argon and liquid oxygen streams therein. Thus, a stream of liquid argon, typically containing up to 2% by volume of oxygen impurity is withdrawn from distillation column 226 through outlet 292 positioned at or near the top of the column 226 at 1178 $sm^3$/hr and 1.2 atmospheres absolute. Liquid oxygen product is withdrawn from the bottom of the column 226 through an outlet 294 at 13592 $sm^3$/hr and 1.4 atmospheres absolute. This liquid oxygen product comprises that formed by fractionation in the column 226, supplemented with a stream of liquid oxygen withdrawn from the column 216 through the outlet 258 and flashed through a throttling or Joule-Thomson valve 296 at 1720 $sm^3$/hr, the resultant 2-phase oxygen mixture entering the bottom of the column 226.

It will be appreciated that net refrigeration for the heat exchanger 206 is provided by the expansion of the mixed oxygen-nitrogen stream from the mixing column 256 in the expansion turbine 266. Accordingly, the stream withdrawn from the mixing column 256 through outlet 264 makes an important contribution to the overall refrigeration requirements of the process.

Figure 5:
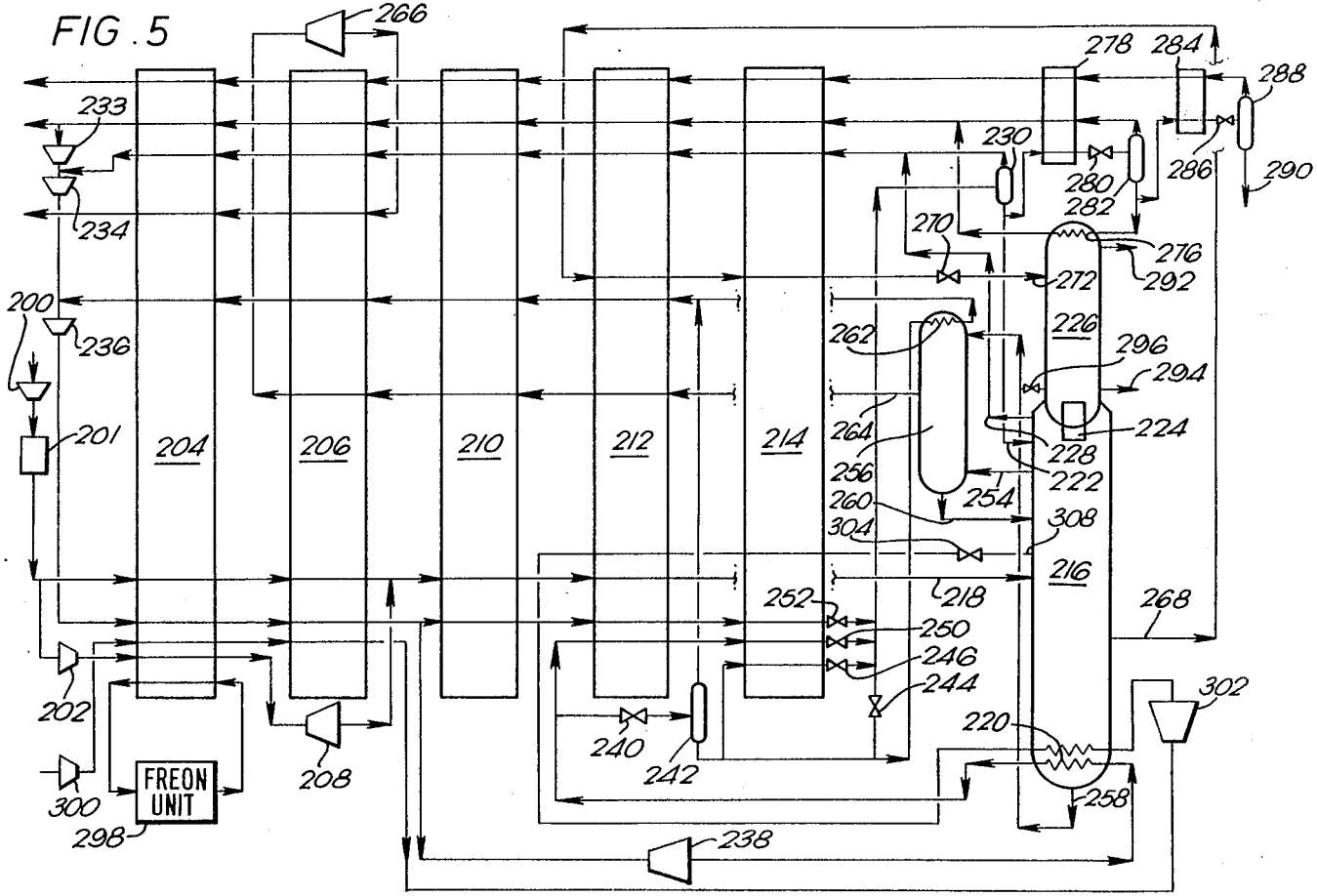
FIG. 5 shows an alternative plant to the one illustrated in FIG. 4.

It will further be appreciated that the expansion turbines 208 and 238 contribute refrigeration to the plant shown in FIG. 5.

Typically, the refrigeration requirements of the heat exchanger 204 operating between the highest temperature limits are met by a mechanical refrigeration machine 298 using Freon (registered trademark) as a working fluid.

If desired, the heat exchangers 204, 206, 210 and 212 may be made as one heat exchange block.

Typically, the compressors 233, 234 and 236 may comprise separate stages of a single multi-stage rotary compressor. Similarly, the compressors 200 and 202 may also comprise separate stages of another plural or multi-stage rotary compressor. Each such compressor will have its own water cooler associated therewith to remove the heat of compression. In addition, the expansion turbines 208, 238 and 266 may each drive a booster compressor used in the compression of the incoming air or nitrogen.

Many modifications to the plant shown in FIG. 4 are possible without dearting from the invention. In particular, it is possible to substitute a column arrangement analogous to the one shown in FIG. 1 for that of FIG. 4. It is desirable to provide the mixing column 256 with a condenser for condensing a stream of vapor withdrawn at a level intermediate that of the outlet 264 and the top of the column where the liquid oxygen from the distillation column 216 is introduced so as to increase the operating efficiency of the mixing column 256. The condensed oxygen-nitrogen mixture is then returned to the mixing column 256. The operation of such a condenser may be as described with reference to FIG. 2. A third modification that may be made to the plant shown in FIG. 4 is illustrated in FIG. 5. Like parts occurring in FIGS. 4 and 5 are indicated by the same reference numerals.

Referring to FIG. 5, not all of the reboil requirements of the column 216 are met by the nitrogen flowing through the reboiler 220. Instead, there is an additional reboil cycle in which the working fluid is air. Accordingly, air is compressed in a compressor 300 to a pressure of 47 atmospheres absolute. After removal of its heat of compression by a water cooler (not shown), the compressed air is cooled to 159K by sequential passage through the heat exchangers 204 and 206, and expanded in expansion turbine 302 to a pressure of 15.6 atmospheres absolute and a temperature of 113.6K. The resultant expanded air is condensed by passage through the reboiler 220. The condensed air is cooled from 113.6K to 98K by sequential passage through heat exchangers 212 and 214. The resulting sub-cooled liquid air is then flashed through throttling or Joule-Thomson valve 304 and a resultant liquid-vapor mixture enters column 216 through inlet 308 located a few trays above inlet 218 at a pressure of 5.9 atmospheres absolute. Typically, the air flow through the turbine 302 is about 7% of the total gas flow through the reboiler 220, and about 8% of the total air introduced into the distillation column 216. By introducing some of the air into the distillation column 216 as liquid, the overall cycle and column efficiencies are improved. In all other respects, the plant shown in FIG. 5 and its operation are similar to the plant shown in FIG. 4 and its operation.

It is to be appreciated that the plants shown in FIGS. 4 and 5 are capable of flexible operation in that the relative rates of production argon, oxygen and nitrogen products may be varied. Thus, the greater are the flow rates of oxygen and nitrogen to the remixing column, the greater is the rate of argon production but the lower the rates of oxygen and nitrogen production.

We claim:

1. A process of separating air into oxygen, nitrogen and argon, comprising:

(a) extracting carbon dioxide and water vapor from air and cooling it to a cryogenic temperature suitable for separation by fractional distillation;

(b) subjecting the air to fractional distillation in a first distillation column operating at a first pressure and withdrawing therefrom oxygen, nitrogen vapor and argon-enriched oxygen;

(c) subjecting the argon-enriched oxygen to further separation in a second distillation column operating at substantially lower pressure than the first column;

(d) withdrawing argon from the second distillation column;

(e) liquefying at least some of the nitrogen vapor formed in step (b) by a cycle which shares at least one heat exchanger in common with the air being cooled in step (a) and which employs compression of nitrogen to a third pressure substantially in excess of the first pressure;

(f) taking a first portion of the liquid nitrogen as product and introducing a second portion thereof into said first distillation column as reflux, wherein liquid oxygen and impure nitrogen are withdrawn from the first distillation column and remixed in a liquid-vapor contact column, impure liquid nitrogen is withdrawn from the said liquid-vapor contact column and used as reflux in the said first distillation column, and a remixed oxygen-nitrogen stream is withdrawn from the said liquid-vapor contact column and is subjected to expansion to create refrigeration.

2. A process in accordance with claim 1, in which a third portion of the liquid nitrogen formed in step (b) is used to condense nitrogen vapor from the liquid-vapor contact column, the resulting condensate being returned to the liquid-vapor contact column, said third portion of liquid nitrogen being thereby vaporized wherein at least part of the vapor is recycled for liquefaction.

3. A process in accordance with claim 1, wherein the liquid-vapor contact column operates at a pressure of at least about 5 atmospheres.

4. A process in accordance with claim 1, wherein the remixed stream of oxygen and nitrogen is withdrawn from an intermediate level of the liquid-vapor contact column.

5. A process in accordance with claim 4, wherein another remixed oxygen-nitrogen stream, enriched in oxygen relative to the first such stream is withdrawn from the liquid-vapor contact column, condensed in heat exchange with a stream of boiling liquid from one of the distillation columns and returned to the mixing column, the resulting boiled liquid being returned to one of the distillation columns.

6. A process in accordance with claim 1, wherein reboil for the first distillation column is provided by a stream of nitrogen at least part of which is liquefied downstream of the first distillation column.

7. A process in accordance with claim 6, wherein reboil is provided for the second distillation column by nitrogen vapor from an additional distillation column to which receives a portion of the air feed.

8. A process in accordance with claim 1, wherein the nitrogen liquefaction cycle in step (e) comprises: withdrawing nitrogen vapor from the first distillation column; warming the nitrogen vapor countercurrently to the air in the heat exchanger; compressing a portion of the warmed nitrogen; cooling the compressed nitrogen in the heat exchange means; taking at least some of the cooled nitrogen and subjecting it to expansion to recover energy therefrom; passing the expanded nitrogen through a reboiler associated with the first distillation column to provide reboil therefor; subjecting the nitrogen leaving the reboiler to further cooling in the heat exchange means; employing a portion of the resulting liquid nitrogen as reflux in the first distillation columns and taking another portion thereof as product.

9. A process in accordance with claim 8, wherein a stream of air is used to provide some of the reboil for the first distillation column and resulting liquid air is introduced into the first distillation column.

10. A process in accordance with claim 8, wherein the nitrogen withdrawn from the first distillation column is compressed to a pressure in excess of its critical pressure.

11. A process in accordance with claim 10, wherein the compressed nitrogen is expanded with the performance of external work at a pressure in the range 50 to 75 atmospheres.

12. A process in accordance with claim 8, wherein liquid nitrogen leaving the reboiler is subjected to a plurality of flash separation steps to provide liquid nitrogen and a plurality of flash gas streams.

13. A process in accordance with claim 12, wherein liquid nitrogen from a first flash separation step is employed to condense nitrogen vapor from the liquid-vapor contact column and the resulting condensate is returned thereof as reflux.

14. A process in accordance with claim 1, wherein reboil is provided for the second distillation column by nitrogen vapor the first distillation column.

15. Apparatus for separating air into oxygen, nitrogen and argon, comprising: means for extracting carbon dioxide and water vapor from air; heat exchange means for cooling air to a cryogenic temperature suitable for separation by fractional distillation; a first distillation column for subjecting the air to fractional distillation, said column having outlets for the withdrawal of liquid oxygen, nitrogen vapor and argon-enriched oxygen; a second distillation column communicating with said outlet for argon-enriched oxygen operable to separate argon therefrom having an outlet for the withdrawal of argon therefrom; means for liquefying at least some of the nitrogen vapor formed in the first distillation column by performing a cycle which utilizes at least a portion of said heat exchange means and which includes at least one compressor for raising the pressure of the nitrogen to a pressure substantially in excess of the pressure at which the first distillation column operates; means for withdrawing some of the liquid nitrogen as product and means for returning a second portion of the liquid nitrogen as reflux to said first distillation column, wherein the apparatus additionally includes a liquid-vapor contact column for remixing liquid oxygen and impure nitrogen vapor, said liquid-vapor contact column having an inlet for liquid oxygen in communication with the outlet therefor from the first distillation column and an inlet for impure nitrogen vapor in communication with an outlet for such vapor from the first distillation column, and also having an outlet for impure liquid nitrogen, in communication with an inlet for such nitrogen to the first distillation column, and another outlet for a remixed oxygen-nitrogen stream communicating with at least one means for expanding said mixture to create refrigeration.

* * * * *

UNITED STATES PATENT AND TRADEMARK OFFICE

CERTIFICATE OF CORRECTION

PATENT NO. : 4,916,908

DATED : April 17, 1990

INVENTOR(S) : LAVIN, John T. and LAYLAND, David J.

It is certified that error appears in the above-identified patent and that said Letters Patent is hereby corrected as shown below:

On the title page item [73] Assignee: please change the Assignee to:

--The BOC Group plc, Windlesham, Surrey, England--.

Signed and Sealed this

Thirtieth Day of June, 1992

*Attest:*

DOUGLAS B. COMER

*Attesting Officer*

*Acting Commissioner of Patents and Trademarks*